US010378282B2

(12) United States Patent
Hadi et al.

(10) Patent No.: US 10,378,282 B2
(45) Date of Patent: Aug. 13, 2019

(54) DYNAMIC FRICTION DRILL STRING OSCILLATION SYSTEMS AND METHODS

(71) Applicant: Nabors Drilling Technologies USA, Inc., Houston, TX (US)

(72) Inventors: Mahmoud Hadi, Richmond, TX (US); Matthew White, Spring, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 15/456,292

(22) Filed: Mar. 10, 2017

(65) Prior Publication Data

US 2018/0258750 A1 Sep. 13, 2018

(51) Int. Cl.

| | |
|---|---|
| ***E21B 44/00*** | (2006.01) |
| ***E21B 7/04*** | (2006.01) |
| ***E21B 7/24*** | (2006.01) |
| ***E21B 44/04*** | (2006.01) |
| ***E21B 47/12*** | (2012.01) |

(52) U.S. Cl.

CPC ..... *E21B 7/04* (2013.01); *E21B 44/04* (2013.01); *E21B 47/12* (2013.01)

(58) Field of Classification Search

CPC ..... E21B 7/04; E21B 7/24; E21B 44/00

See application file for complete search history.

(56) References Cited

U.S. PATENT DOCUMENTS

| | | | |
|---|---|---|---|
| 1,891,329 | A | 12/1932 | Le Compte et al. |
| 2,005,889 | A | 6/1935 | Dillon et al. |
| 2,724,574 | A | 11/1955 | Ledgerwood, Jr. |
| 3,223,183 | A | 12/1965 | Varney |
| 3,265,359 | A | 8/1966 | Bowden |
| 3,407,886 | A | 10/1968 | Bennett |

(Continued)

FOREIGN PATENT DOCUMENTS

| | | |
|---|---|---|
| EP | 0774563 B1 | 7/2002 |
| RU | 2208153 C2 | 7/2003 |

(Continued)

OTHER PUBLICATIONS

"40223705-Series Wildcat Services Pneumatic Automated Drilling System," available at http://www.nov.com/Drilling/Control_and_Advisory_Systems/Drawworks_Control_Auto_Drilling/Auto_Drillers.aspx (last visited Oct. 8, 2009).

(Continued)

*Primary Examiner* — David J Bagnell
*Assistant Examiner* — Dany E Akakpo
(74) *Attorney, Agent, or Firm* — Haynes and Boone, LLP

(57) ABSTRACT

Systems and methods for slide drilling are described. The system includes a controller and a drive system. The controller is configured to determine a resonant frequency of a drill string, generate a rotational acceleration profile having a frequency at least substantially similar to the determined resonant frequency, and provide one or more operational control signals to oscillate the drill string based on the generated rotational acceleration profile. The drive system is configured to receive the one or more operational control signals from the controller, and oscillate the drill string based on the generated rotational acceleration profile so that the drill string oscillates at a frequency substantially similar to the determined resonant frequency while slide drilling.

21 Claims, 5 Drawing Sheets

(56) References Cited

U.S. PATENT DOCUMENTS

| | | | |
|---|---|---|---|
| 3,550,697 | A | 12/1970 | Hobhouse |
| 3,658,138 | A | 4/1972 | Gosselin |
| 4,128,888 | A | 12/1978 | Sheldon et al. |
| 4,146,347 | A | 3/1979 | Woods |
| 4,165,789 | A | 8/1979 | Rogers |
| 4,174,577 | A | 11/1979 | Lewis |
| 4,187,546 | A | 2/1980 | Heffernan et al. |
| 4,195,699 | A | 4/1980 | Rogers et al. |
| 4,281,723 | A | 8/1981 | Edmond et al. |
| 4,354,233 | A | 10/1982 | Zhukovsky et al. |
| 4,453,603 | A | 6/1984 | Voss et al. |
| 4,492,276 | A | 1/1985 | Kamp |
| 4,535,972 | A | 8/1985 | Millheim et al. |
| 4,601,353 | A | 7/1986 | Schuh et al. |
| 4,662,608 | A | 5/1987 | Ball |
| 4,739,325 | A | 4/1988 | MacLeod |
| 4,794,534 | A | 12/1988 | Millheim |
| 4,854,397 | A | 8/1989 | Warren et al. |
| 4,958,125 | A | 9/1990 | Jardine et al. |
| 5,042,597 | A | 8/1991 | Rehm et al. |
| 5,103,919 | A | 4/1992 | Warren et al. |
| 5,103,920 | A | 4/1992 | Patton |
| 5,205,163 | A | 4/1993 | Sananikone |
| 5,316,091 | A | 5/1994 | Rasi et al. |
| 5,337,839 | A | 8/1994 | Warren et al. |
| 5,358,059 | A | 10/1994 | Ho |
| 5,390,748 | A | 2/1995 | Goldman |
| 5,425,429 | A | 6/1995 | Thompson |
| 5,467,832 | A | 11/1995 | Orban et al. |
| 5,474,142 | A | 12/1995 | Bowden |
| 5,513,710 | A | 5/1996 | Kuckes |
| 5,551,286 | A | 9/1996 | Booer |
| 5,713,422 | A | 2/1998 | Dhindsa |
| 5,730,234 | A | 3/1998 | Putot |
| 5,738,178 | A | 4/1998 | Williams et al. |
| 5,803,185 | A | 9/1998 | Barr et al. |
| 5,842,149 | A | 11/1998 | Harrell et al. |
| 6,026,912 | A | 2/2000 | King et al. |
| 6,029,951 | A | 2/2000 | Guggari |
| 6,050,348 | A | 4/2000 | Richardson et al. |
| 6,065,332 | A | 5/2000 | Dominick |
| 6,092,610 | A | 7/2000 | Kosmala et al. |
| 6,152,246 | A | 11/2000 | King et al. |
| 6,155,357 | A | 12/2000 | King et al. |
| 6,192,998 | B1 | 2/2001 | Pinckard |
| 6,293,356 | B1 | 9/2001 | King et al. |
| 6,382,331 | B1 | 5/2002 | Pinckard |
| 6,405,808 | B1 | 6/2002 | Edwards et al. |
| 6,757,613 | B2 | 6/2004 | Chapman et al. |
| 6,802,378 | B2 | 10/2004 | Haci et al. |
| 6,820,702 | B2 | 11/2004 | Niedermayr et al. |
| 6,892,812 | B2 | 5/2005 | Niedermayr et al. |
| 7,000,710 | B1 | 2/2006 | Umbach |
| 7,032,689 | B2 | 4/2006 | Goldman et al. |
| 7,044,239 | B2 | 5/2006 | Pinckard et al. |
| 7,059,427 | B2 | 6/2006 | Power et al. |
| 7,085,696 | B2 | 8/2006 | King |
| 7,096,979 | B2 | 8/2006 | Haci et al. |
| 7,100,698 | B2 | 9/2006 | Kracik et al. |
| 7,140,452 | B2 | 11/2006 | Hutchinson |
| 7,243,735 | B2 | 7/2007 | Koederitz et al. |
| 7,357,196 | B2 | 4/2008 | Goldman et al. |
| 7,404,454 | B2 | 7/2008 | Hulick |
| 7,419,012 | B2 | 9/2008 | Lynch |
| 7,461,705 | B2 | 12/2008 | Hulick et al. |
| 7,543,658 | B2 | 6/2009 | Russell et al. |
| 7,546,209 | B2 | 6/2009 | Williams |
| 7,584,788 | B2 | 9/2009 | Baron et al. |
| 7,588,099 | B2 | 9/2009 | Kracik |
| 7,588,100 | B2 | 9/2009 | Hamilton |
| 7,665,533 | B2 | 2/2010 | Hopwood et al. |
| 7,775,297 | B2 | 8/2010 | Hopwood et al. |
| 7,823,655 | B2 | 11/2010 | Boone et al. |
| 7,860,593 | B2 | 12/2010 | Boone |
| 7,938,197 | B2 | 5/2011 | Boone et al. |
| 8,215,417 | B2 | 7/2012 | Annaiyappa et al. |
| 8,360,171 | B2 | 1/2013 | Boone et al. |
| 8,510,081 | B2 | 8/2013 | Boone |
| 8,528,663 | B2 | 9/2013 | Boone |
| 8,602,126 | B2 | 12/2013 | Boone et al. |
| 8,672,055 | B2 | 3/2014 | Boone et al. |
| 9,290,995 | B2 | 3/2016 | Boone et al. |
| 2002/0104685 | A1 | 8/2002 | Pinckard et al. |
| 2003/0024738 | A1 | 2/2003 | Schuh |
| 2004/0028476 | A1 | 2/2004 | Payne et al. |
| 2004/0118612 | A1 | 6/2004 | Haci et al. |
| 2004/0222023 | A1 | 11/2004 | Haci et al. |
| 2004/0238222 | A1 | 12/2004 | Harrison |
| 2006/0081399 | A1 | 4/2006 | Jones |
| 2006/0185899 | A1 | 8/2006 | Alft et al. |
| 2006/0195307 | A1 | 8/2006 | Huang et al. |
| 2007/0175662 | A1 | 8/2007 | Kracik |
| 2007/0181343 | A1 | 8/2007 | Russell et al. |
| 2007/0203651 | A1 | 8/2007 | Blanz et al. |
| 2007/0256861 | A1 | 11/2007 | Hulick |
| 2007/0256863 | A1 | 11/2007 | Hulick et al. |
| 2008/0156531 | A1 | 7/2008 | Boone et al. |
| 2008/0173480 | A1 | 7/2008 | Annaiyappa et al. |
| 2008/0281525 | A1 | 11/2008 | Boone |
| 2009/0058674 | A1 | 3/2009 | Papouras et al. |
| 2009/0065258 | A1 | 3/2009 | Hamilton |
| 2009/0078462 | A1 | 3/2009 | Boone et al. |
| 2009/0090555 | A1 | 4/2009 | Boone et al. |
| 2009/0159336 | A1 | 6/2009 | Boone |
| 2009/0250264 | A1 | 10/2009 | Dupriest |
| 2009/0266608 | A1* | 10/2009 | Jeffryes ..... E21B 44/04 175/27 |
| 2010/0082256 | A1 | 4/2010 | Mauldin et al. |
| 2011/0024187 | A1 | 2/2011 | Boone et al. |
| 2011/0056750 | A1* | 3/2011 | Lucon ..... E21B 7/24 175/56 |
| 2012/0048621 | A1* | 3/2012 | Stewart ..... E21B 7/04 175/56 |
| 2014/0158428 | A1* | 6/2014 | Boone ..... E21B 7/24 175/40 |

FOREIGN PATENT DOCUMENTS

| | | |
|---|---|---|
| SU | 1668652 | 8/1991 |
| WO | WO 1993/012318 | 6/1993 |
| WO | WO 2004/055325 | 7/2004 |
| WO | WO 2006/079847 | 8/2006 |
| WO | WO 2007/073430 | 6/2007 |
| WO | WO 2008/070829 | 12/2008 |
| WO | WO 2009/039448 | 3/2009 |
| WO | WO 2009/039453 | 3/2009 |

OTHER PUBLICATIONS

"Wildcat ADS Automated Drilling System," Product Brochure, National Oilwell Varco, Inc. (2006).

Bonner, et al., "Measurements at the Bit: A New Generation of MWD Tools," *Oilfield Review*, pp. 44-54, Apr./Jul. 1993.

Brett, et al., "Field Experiences with Computer-Controlled Drilling," *Society of Petroleum Engineers 20107*, presented at Permian Basin Oil and Gas Recovery Conference, Midland, TX (Mar. 8-9, 1990).

Brown, et al., "In-Time Data Delivery," *Oilfield Review*, 11(4): 34-55, available at http://www.slb.com/media/services/resources/oilfieldreview/ors99/win99/pages34_55.pdf (Winter 1999/2000).

Dupriest, Fred E., "Maximizing ROP With Real-Time Analysis of Digital Data and MSE" at the International Petroleum Technology Conference, Doha, Qatar, Nov. 21-23, 2005, pp. 1-8.

Dupriest, Fred E., et al., "Comprehensive Drill-Rate Management Process to Maximize Rate of Penetration" at SPE Annual Technical Conference and Exhibition, San Antonio, Texas, Sep. 2006, pp. 1-9.

Dupriest, Fred E., et al., "Maximizing Drill Rates with Real-Time Surveillance of Mechanical Specific Energy" at SPE/IADC Drilling Conference 92194, Amsterdam, The Netherlands, Feb. 23-25, 2005, pp. 1-10.

(56) References Cited

OTHER PUBLICATIONS

Goldman, "Artificial Intelligence Applications Enhance Directional Control," *Petroleum Engineer International*, pp. 15-22, Feb. 1993.
Gurari, E., "CIS 680: Data Structures: Chapter 19: Backtracking Algorithms;" available at http://www.cse.ohio-state.edu/%7Egurari/course/cis680/cis680Ch19.html (1999).
Hartley, Frank, et al., "New Drilling Process Increases Rate of Penetration, Footage Per Day," in Offshore, vol. 66, Issue 1, Jan. 2006, pp. 1-5.
Jackson, et al., "Portable Top Drive Cuts Horizontal Drilling Costs," *World Oil Magazine*, vol. 214 Issue 11, pp. 81-89, Nov. 1993.
Leine, et al., "Stick-Slip Whirl Interaction in Drillstring Dynamics," *J. of Vibration and Acoustics*, 124: 209-220 (2002).
Maidla, Eric, et al., Understanding Torque: The Key to Slide-Drilling Directional Wells, International Association of Drilling Contractors, Society of Petroleum Engineers, paper selected for presentation by IADC/SPE Program Committee at the IADS/SPE Drilling Conference held in Dallas, TX, Mar. 2-4, 2004, IADC/SPE 87162.
Murch, "Application of Top Drive Drilling to Horizontal Wells," Society of Petroleum Engineers—SPE 37100, 1996.
Petroleum Extension Service, "Controlled Directional Drilling," N. Janicek (ed.), Third Edition, pp. 18-33 and 44-45, 1984.
Young, Jr., "Computerized Drilling Control," *Journal of Petroleum Technology*, 21(4): 483-96 (1969).
Roberto H. Tello Kragjcek et al., "Successful Application of New Sliding Technology for Horizontal Drilling in Saudi Arabia" Saudi Aramco Journal of Technology, Fall 2011, pp. 28-33.
International Search Report and Written Opinion issued for PCT/US2013/070970 dated Feb. 28, 2014, 14 pgs.

* cited by examiner

DYNAMIC FRICTION DRILL STRING OSCILLATION SYSTEMS AND METHODS

TECHNICAL FIELD

The present disclosure is directed to systems, devices, and methods for slide drilling. More specifically, the present disclosure is directed to systems, devices, and methods for slide drilling by vibrating a drill string at its resonant or natural frequency to reduce friction of the drill string in the borehole and to promote free movement of the drill string in the borehole.

BACKGROUND OF THE DISCLOSURE

Underground drilling involves drilling a bore through a formation deep in the Earth using a drill bit connected to a drill string. Two common drilling methods, often used within the same hole, include rotary drilling and slide drilling. Rotary drilling typically includes rotating the drilling string, including the drill bit at the end of the drill string, and driving it forward through subterranean formations. This rotation often occurs via a top drive or other rotary drive means at the surface, and as such, the entire drill string rotates to drive the bit. This is often used during straight runs, where the objective is to advance the bit in a substantially straight direction through the formation.

Slide drilling is often used to steer the drill bit to effect a turn in the drilling path. For example, slide drilling may employ a drilling motor with a bent housing incorporated into the bottom hole assembly (BHA) of the drill string. During typical slide drilling, the drill string is not rotated and the drill bit is rotated exclusively by the drilling motor. The bent housing steers the drill bit in the desired direction as the drill string slides through the bore, thereby effectuating directional drilling. Alternatively, the steerable system can be operated in a rotating mode in which the drill string is rotated while the drilling motor is running.

Directional drilling can also be accomplished using rotary steerable systems that include a drilling motor that forms part of the BHA, as well as some type of steering device, such as extendable and retractable arms that apply lateral forces along a borehole wall to gradually effect a turn. In contrast to steerable motors, rotary steerable systems permit directional drilling to be conducted while the drill string is rotating. As the drill string rotates, frictional forces are reduced and more bit weight is typically available for drilling. Hence, a rotary steerable system can usually achieve a higher rate of penetration during directional drilling relative to a steerable motor, since the combined torque and power of the drill string rotation and the downhole motor are applied to the bit.

A problem with conventional slide drilling arises when the drill string is not rotated because much of the weight on the bit applied at the surface is countered by the friction of the drill pipe on the walls of the wellbore. This becomes particularly pronounced during long lengths of a horizontally drilled bore hole.

To reduce wellbore friction during slide drilling, a top drive may be used to oscillate or rotationally rock the drill string during slide drilling to reduce drag of the drill string in the wellbore. This oscillation can reduce friction in the borehole. Too much oscillation can disrupt the direction of the drill bit, however, sending it off-course during the slide drilling process, and too little oscillation can minimize the benefits of the friction reduction. Either can result in a non-optimal weight-on-bit, and overly slow and inefficient slide drilling.

The parameters relating to the top-drive oscillation, such as the number of oscillating rotations (e.g., the number of right and left turns) or the amount of right/left torque or energy applied, are typically programmed into the top drive system by an operator, and may not be optimal for every drilling situation. The system may underperform due to the wrong settings the operator inputs. Underperforming may mean that the friction between the drill string and the wellbore will not be broken, and/or that the rate of penetration may be lower than what could possibly be achieved while slide drilling.

For example, the same number of oscillation revolutions may be used regardless of whether the drill string is relatively long or relatively short, and regardless of the sub-geological structure or changing structure during a drilling operation. Drilling operators, concerned about turning the bit off-course during an oscillation procedure, may under-utilize the oscillation option, limiting its effectiveness. Because of this, in some instances, an optimal oscillation may not be achieved, resulting in relatively less efficient drilling and potentially less bit progression than desired or achievable.

Thus, what are needed are systems, apparatuses, and methods that provide an effective slide drilling oscillation amount during a drilling process.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
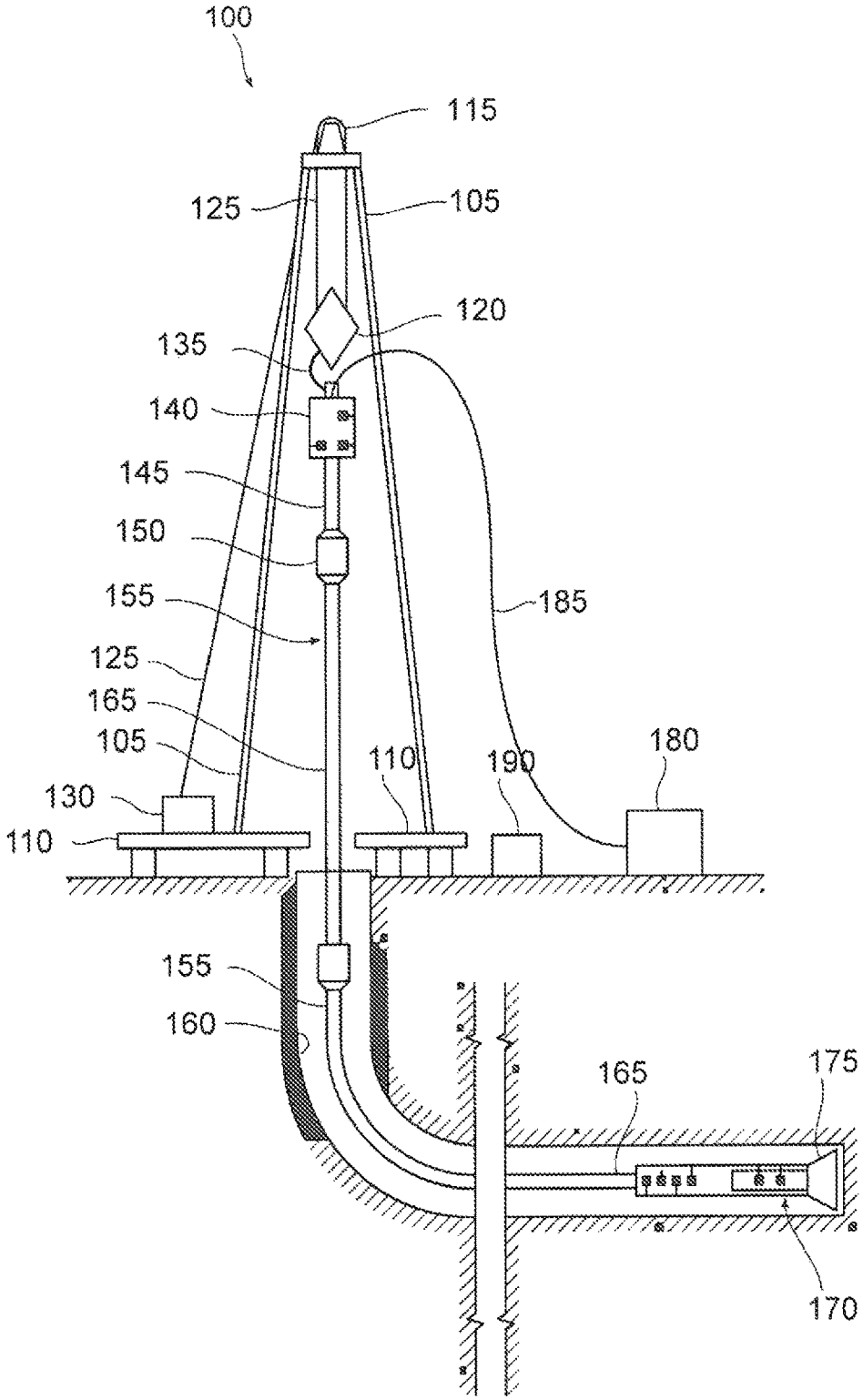
FIG. 1 is a diagram of an apparatus shown as an exemplary drilling rig according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure provides apparatuses, systems, and methods for enhanced directional steering control for a drilling assembly, such as a downhole assembly in a drilling operation. The devices, systems, and methods allow a user (alternately referred to herein as an "operator") to provide or change a rocking technique to oscillate a tubular string in a manner that improves the drilling operation. The oscillation is useful to reduce the amount of friction between the drill string and the wellbore, for example, by converting static friction to dynamic friction from the oscillating movement.

By drilling or drill string, this term is generally also meant to include any tubular string. In one embodiment, the term drilling can include casing drilling, and drill string includes a casing string. This improvement may manifest itself, for example, by increasing the drilling speed, penetration rate, the usable lifetime of the component (e.g., through reduced frictional wear compared to drilling that is not according to the present disclosure), and/or other improvements. In one aspect, an enhancement to the rocking mechanism is implemented to get a more effective way of breaking the friction (or minimizing or preventing such friction during drilling) even if the wrong rocking settings or parameters are input by the operator.

Using drill string dynamics, specifically by accounting for the torsional resonance frequency of the drill string, and exciting the drill string with that frequency (or a substantially similar frequency, e.g., within about 10%, or preferably within about 5%, or more preferably within about 2%, of the resonance frequency), while slide drilling, the drill string is agitated and kept in motion sufficiently to stay in the dynamic friction range and avoid sticking. This also ensures better weight transfer to the drilling bit and more time with the drilling bit in operation, which results in faster rate of penetration (ROP) while sliding drilling. In an embodiment, a small amplitude sine wave at the desired frequency (e.g., resonant frequency or a substantially similar frequency) is overlaid over a rotational speed (rotations per minute (RPM)) command of a top drive. By "small" amplitude it is meant from about ½ to 5 RPMs in either direction, either symmetrically or asymmetrically. The base rotational speed may even involve symmetric or asymmetric rotation of the drill bit to help maintain the toolface orientation in a desired direction. U.S. Pat. Nos. 6,050,348; 7,823,655; 8,360,171; 8,528,663; 8,602,126; 8,672,055; and 9,290,995 relate to oscillating a drill string, and are incorporated by reference in their entirety by express reference thereto. The small amplitude sine wave added to the rotational speed helps ensure that the drill string and bottom hole assembly (BHA) resonate around the desired toolface orientation while minimizing frictional sticking of the drill string and BHA but without moving the toolface outside of an acceptable range. In another embodiment, the quill rocking speed command is profiled or set to the sine wave with the resonant frequency. In other words, full oscillation at the resonant frequency is provided by the speed command. The sine wave can be tuned to the resonant frequency of the drill string based on knowledge of the effective torsional spring constant or stiffness ($K_f$) of the drill string being matched to reduce torque wave reflections and moment of inertia (I) of the top drive, or a substantially similar frequency. This is equivalent to the resonant frequency calculated from actual torsional stiffness of the drill string and the moment of inertia of the BHA.

Natural or resonant frequencies are frequencies at which a structure likes to move and vibrate. If the drill string is excited at one of its natural frequencies, then resonance is encountered and large amplitude oscillations may result. The largest amplitude displacements tend to occur at the first (fundamental) natural frequency. Resonance frequencies are the natural frequencies at which it is easiest to get an object to vibrate.

In one aspect, the present disclosure is directed to apparatuses, systems, and methods of drilling that include modifying an acceleration profile (i.e., rotational acceleration profile) of the top drive to change the drilling effectiveness of the drilling system. The modified acceleration profile may be selected and controlled to identify the most effective, or optimized, rocking signature or technique. The apparatus, systems, and methods disclosed herein may be employed with any type of directional drilling system using a rocking technique, such as handheld oscillating drills, casing running tools, tunnel boring equipment, mining equipment, and oilfield-based equipment such as those including top drives. The apparatus is further discussed herein in connection with oilfield-type equipment, but the directional steering apparatus and methods of this disclosure may have applicability to a wide array of fields including those noted above.

The present disclosure describes, in certain aspects, systems and methods for moving a bit efficiently and effectively through a formation while inhibiting or preventing binding of the drill string on the formation and maintaining a desired toolface orientation during drilling. In certain aspects, such systems and methods reduce sliding friction of the drill string with respect to the formation.

In a second aspect, the present disclosure is directed to apparatuses, systems, and methods that include providing an acceleration profile that utilizes the resonant frequency, or a substantially similar frequency, of the drill string that is used. In these embodiments, the drill string is agitated at the resonant frequency by rotating the drill string at a certain rotational speed (e.g., in both left and right directions from a neutral position) at the surface. The torque limit can be set by the operator, e.g., based on part on the maximum torque or some downhole tools and make-up torque. Thus, in one embodiment, the top drive effectively functions as a mechanical vibrator or forcing mechanism to achieve the desired torsional agitation in addition to its conventional drilling function. In an embodiment, the drill string is oscillated during a slide drilling procedure to reduce the amount of friction present on the drill string (e.g., where in contact with a side of the wellbore) such as by converting static friction to dynamic friction and/or to prevent a drill string to stick during drilling operations. In some embodiments, the toolface orientation is maintained while rocking or oscillating the drill string, and in other embodiments, the toolface orientation is changed to a new, desired orientation while oscillating during a slide drilling procedure.

In various embodiments, the vibration is applied such that the whole length of the drill string is vibrated. Vibrating less than the whole length is also possible if desired. Where less than the whole length of the drill string is vibrated, one approach is to apply the vibration(s) at one or more points with expected or actual relatively higher friction since such point(s) can have a significant impact on the operation of the drilling system.

Referring to FIG. 1, illustrated is a diagram of an apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

The apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel out and reel in the drilling line 125 to cause the traveling block 120 to be lowered and raised relative to the rig floor 110. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. In several exemplary embodiments, the top drive 140 is a variable-frequency drive. A quill 145 extending from the top drive 140 is attached to a saver sub 150, which is attached to a drill string 155 suspended within a wellbore 160. Alternatively, the quill 145 may be attached to the drill string 155 directly. It should be understood that other conventional techniques for arranging a rig do not require a drilling line, and these are included in the scope of this disclosure. In another aspect (not shown), no quill is present.

The drill string 155 includes interconnected sections of drill pipe 165, a bottom hole assembly (BHA) 170, and a drill bit 175. The bottom hole assembly 170 may include stabilizers, drill collars, and/or measurement-while-drilling (MWD) or wireline conveyed instruments, among other components. The drill bit 175, which may also be referred to herein as a tool, is connected to the bottom of the BHA 170 or is otherwise attached to the drill string 155. One or more pumps 180 may deliver drilling fluid to the drill string 155 through a hose or other conduit 185, which may be fluidically and/or actually connected to the top drive 140.

In the exemplary embodiment depicted in FIG. 1, the top drive 140 is used to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

The apparatus 100 also includes a control system 190 configured to control or assist in the control of one or more components of the apparatus 100. For example, the control system 190 may be configured to transmit operational control signals to the drawworks 130, the top drive 140, the BHA 170 and/or the pump 180. The control system 190 may be a stand-alone component installed near the mast 105 and/or other components of the apparatus 100. In some embodiments, the control system 190 is physically displaced at a location separate and apart from the drilling rig.

Figure 2:
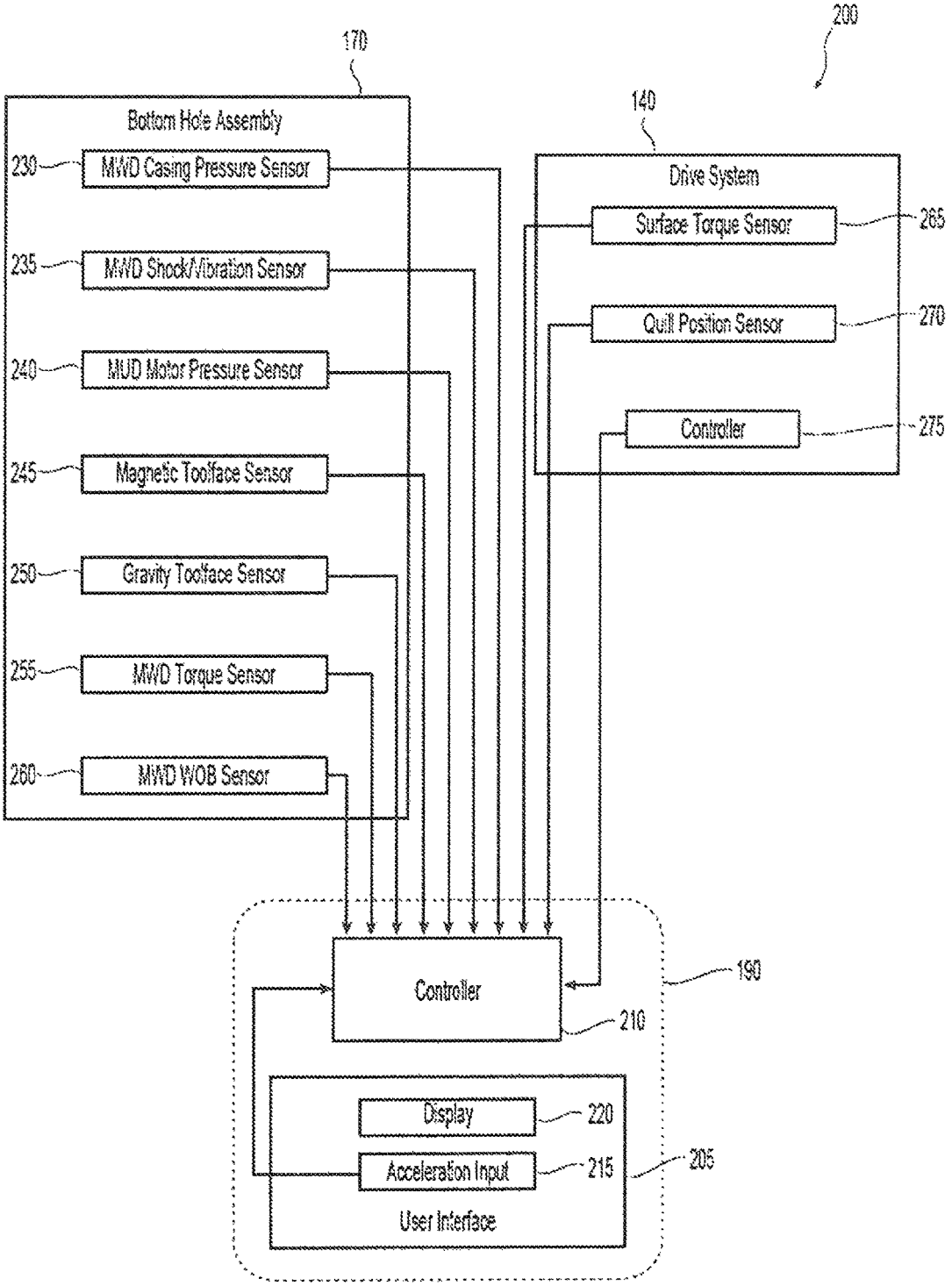
FIG. 2 is a block diagram of an apparatus shown as an exemplary control system according to one or more aspects of the present disclosure.

FIG. 2 illustrates a block diagram of a portion of an apparatus 200 according to one or more aspects of the present disclosure. FIG. 2 shows the control system 190, the BHA 170, and the top drive or drive system 140. The apparatus 200 may be implemented within the environment and/or the apparatus shown in FIG. 1.

The control system 190 includes a user-interface 205 and a controller 210. Depending on the embodiment, these may be discrete components that are interconnected via wired or wireless means. Alternatively, the user-interface 205 and the controller 210 may be integral components of a single system.

The user-interface 205 includes an input mechanism 215 for user-input of one or more drilling settings or parameters. For example, the input mechanism 215 may permit a user to input a left oscillation revolution setting and a right oscillation revolution setting, e.g., for use at the start of a slide drilling operation to reduce friction on the drill string 155 while in the wellbore. These settings control the number of revolutions of the drill string 155 as the control system 190 controls the top drive 140 or other drive system to oscillate the top portion of the drill string 155. The input mechanism 215 may also be used to input additional drilling settings or parameters, such as acceleration, desired toolface orientation, toolface set points, toolface setting limits, rotation settings, and other set points or input data, including predetermined parameters that may determine the limits of oscillation. Further, a user may input information relating to the drilling parameters of the drill string 155, such as BHA 170 information or arrangement, drill pipe size, bit type, depth, formation information, and drill pipe material, among other things. These drilling parameters are useful, for example, in determining a composition of the drill string 155 to better measure the torsional resonant frequency of the drill string 140.

The input mechanism 215 may include a keypad, voice-recognition apparatus, dial, button, switch, slide selector, toggle, joystick, mouse, data base and/or other conventional or future-developed data input device. Such an input mechanism 215 may support data input from local and/or remote locations. Alternatively, or additionally, the input mechanism 215 may permit user-selection of predetermined profiles, algorithms, set point values or ranges, such as via one or more drop-down menus. The data may also or alternatively be selected by the controller 210 via the execution of one or more database look-up procedures. In general, the input mechanism 215 and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other means.

The user-interface 205 may also include a display 220 for visually presenting information to the user in textual, graphic, or video form. The display 220 may also be utilized by the user to input drilling parameters, limits, or set point data in conjunction with the input mechanism 215. For example, the input mechanism 215 may be integral to or otherwise communicably coupled with the display 220.

The BHA 170 may include one or more sensors, typically a plurality of sensors, located and configured about the BHA to detect parameters relating to the drilling environment, the BHA condition and orientation, and other information. In the embodiment shown in FIG. 2, the BHA 170 includes an optional MWD casing pressure sensor 230 that is configured to detect an annular pressure value or range at or near the MWD portion of the BHA 170. The casing pressure data detected via the MWD casing pressure sensor 230 may be sent via electronic signal to the controller 210 via wired or wireless transmission.

The BHA 170 may also include an MWD shock/vibration sensor 235 that is configured to detect shock and/or vibration in the MWD portion of the BHA 170. The shock/vibration data detected via the MWD shock/vibration sensor 235 may be sent via electronic signal to the controller 210 via wired or wireless transmission.

The BHA 170 may also include a mud motor AP sensor 240 that is configured to detect a pressure differential value or range across the mud motor of the BHA 170. The pressure differential data detected via the mud motor AP sensor 240 may be sent via electronic signal to the controller 210 via wired or wireless transmission. The mud motor AP may be alternatively or additionally calculated, detected, or otherwise determined at the surface, such as by calculating the difference between the surface standpipe pressure just off-bottom and pressure once the bit touches bottom and starts drilling and experiencing torque.

The BHA 170 may also include a magnetic toolface sensor 245 and a gravity toolface sensor 250 that are cooperatively configured to detect the current toolface. The magnetic toolface sensor 245 may be or include a conventional or future-developed magnetic toolface sensor which detects toolface orientation relative to magnetic north or true north. The gravity toolface sensor 250 may be or include a conventional or future-developed gravity toolface sensor that detects toolface orientation relative to the Earth's gravitational field. In an exemplary embodiment, the magnetic toolface sensor 245 may detect the current toolface when the end of the wellbore is less than about 7° from vertical, and the gravity toolface sensor 250 may detect the current toolface when the end of the wellbore is greater than about 7° from vertical. However, other toolface sensors may also be utilized within the scope of the present disclosure that may be more or less precise or have the same degree of precision, including non-magnetic toolface sensors and non-gravitational inclination sensors. In any case, the toolface orientation detected via the one or more toolface sensors (e.g., sensors 245 and/or 250) may be sent via electronic signal to the controller 210 via wired or wireless transmission.

The BHA 170 may also include an MWD torque sensor 255 that is configured to detect a value or range of values for torque applied to the bit by the motor(s) of the BHA 170. The torque data detected via the MWD torque sensor 255 may be sent via electronic signal to the controller 210 via wired or wireless transmission.

The BHA 170 may also include an MWD weight-on-bit (WOB) sensor 260 that is configured to detect a value or range of values for WOB at or near the BHA 170. The WOB data detected via the MWD WOB sensor 260 may be sent via electronic signal to the controller 210 via wired or wireless transmission.

The top drive 140 includes a surface torque sensor 265 that is configured to detect a value or range of the reactive torsion of the quill 145 or drill string 155. The torque sensor can also be utilized to detect the torsional resonant frequency of the drill string by applying a Fast Fourier Transform on the torque signal while rotary drilling. The top drive 140 also includes a quill position sensor 270 that is configured to detect a value or range of the rotational position of the quill, such as relative to true north or another stationary reference. The surface torsion and quill position data detected via sensors 265 and 270, respectively, may be sent via electronic signal to the controller 210 via wired or wireless transmission. In FIG. 2, the top drive 140 also is associated with a controller 275 and/or other means for controlling the rotational position, speed and direction of the quill 145 or other drill string component coupled to the top drive 140 (such as the quill 145 shown in FIG. 1). Depending on the embodiment, the controller 275 may be integral with or may form a part of the controller 210.

The controller 210 is configured to receive detected information (i.e., measured or calculated) from the user-interface 205, the BHA 170, and/or the top drive 140, and utilize such information to continuously, periodically, or otherwise operate to determine an operating parameter having improved effectiveness. The controller 210 may be further configured to generate a control signal, such as via intelligent adaptive control, and provide the control signal to the top drive 140 to adjust and/or maintain the BHA orientation.

Moreover, as in the exemplary embodiment depicted in FIG. 2, the controller 275 of the top drive 140 may be configured to generate and transmit a signal to the controller 210. Consequently, the controller 275 of the top drive 140 may be configured to influence the control of the BHA 170 to assist in obtaining and/or maintaining a desired acceleration profile. Consequently, the controller 275 of the top drive 140 may be configured to cooperate in obtaining and/or maintaining a desired toolface orientation and/or a desired acceleration profile. Such cooperation may be independent of control provided to or from the controller 210 and/or the BHA 170.

Figure 3:
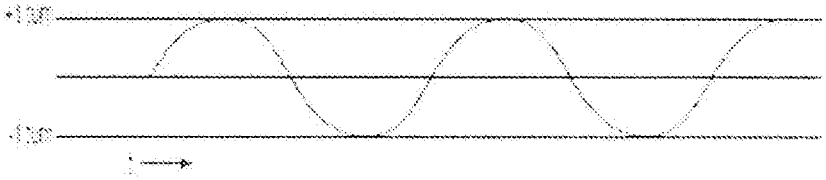
FIG. 3 is a diagram of an exemplary sinusoidal acceleration profile according to one or more aspects of the present disclosure.
Figure 4:
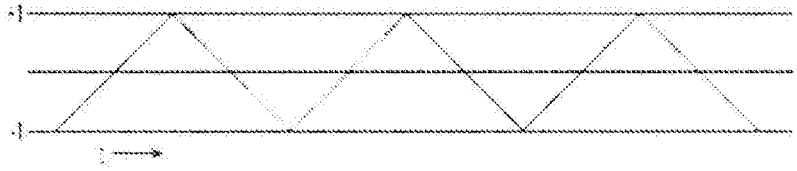
FIG. 4 is a diagram of an exemplary triangular wave-form type acceleration profile according to one or more aspects of the present disclosure.

FIGS. 3-4 show graphs of exemplary acceleration profiles that may be implemented by top drive 140 (or alternatively or additively, any other rotary drive) to obtain and/or maintain a desired acceleration profile and/or a desired toolface orientation.

FIG. 3 shows a first exemplary acceleration profile as a relatively sinusoidal wave-form type (e.g., a sine wave). In certain embodiments, the acceleration profile is characteristic of the action of the top drive 140 when tuning the drill string to its resonant frequency. The acceleration profile represents the position of the top drive 140 as it rocks back and forth to rock or oscillate the drill string. It also in a general sense represents the position of the rotating top drive 140 over time. The top drive 140 rotates in a first direction until an operational rotational setting is reached, and which point, the top drive 140 rotates in an opposite direction. For the sake of explanation, in the exemplary acceleration profile shown, the rotational settings are one turn in each direction from a neutral position, shown as a positive turn and shown as a negative turn over time. In FIG. 3, the top drive 140 follows an acceleration profile represented by a smooth increase in rotational speed, followed by a smooth decrease in rotational speed until the top drive 140 stops and rotates in the opposite direction. It should be understood, however, that the rotations used herein in the acceleration profiles may be up to about five (5) turns in either direction.

FIG. 4 shows an alternative profile that may provide a more aggressive rocking technique, and may result in a more aggressive cut. In this acceleration profile, the top drive 140 may rotate in one direction at a constant rate until the rotational limit is reached, and then the top drive may abruptly rotate in the opposite direction at a substantially constant rate. Accordingly, FIG. 4 shows a triangular wave-form type. In certain embodiments, this acceleration profile is characteristic of a typical rocking technique.

Figure 5:
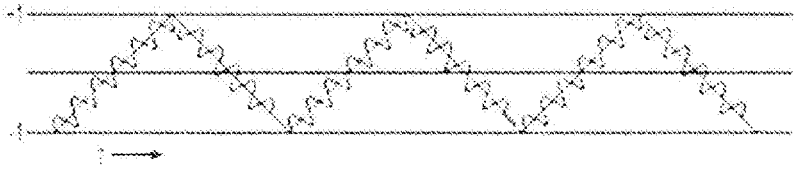
FIG. 5 is an diagram of an exemplary modified acceleration profile combining the profiles of FIGS. 3 and 4 according to one or more aspects of the present disclosure.

FIG. 5 shows another profile that may provide a more aggressive rocking technique, and may result in a more aggressive cut to increase drilling efficiency. In this profile, the top drive 140 may rotate in one direction at a variable rate based on the torsional resonant frequency of the drill string until the rotational limit is reached, and then the top drive may abruptly rotate in the opposite direction at a similar variable rate based on the torsional resonant frequency of the drill string, or a substantially similar frequency.

Figure 6:
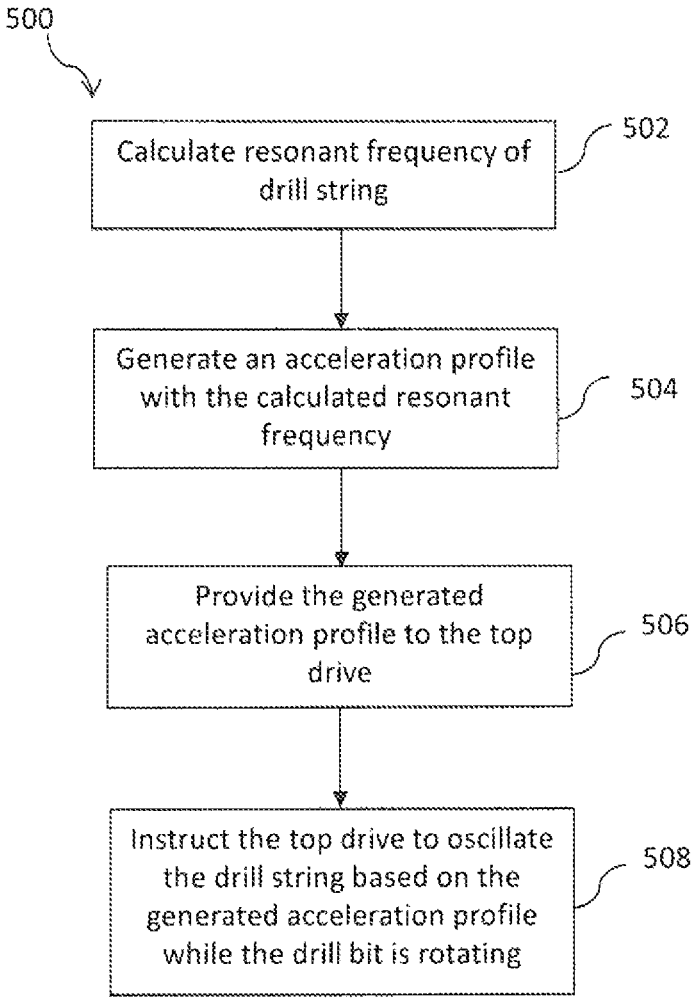
FIG. 6 is an exemplary flow chart showing an exemplary process of oscillating a drill string according to one or more aspects of the present disclosure.

FIG. 6 is a flow chart showing an exemplary method 500 of oscillating a drill string at its natural or resonant frequency according to aspects of the present disclosure. The method 500 may be performed, for example, with respect to the controller 190 and the apparatus 100 components discussed above with respect to FIG. 1. It is understood that additional steps can be provided before, during, and after the steps of method 500.

At block 502, the resonant frequency of the drill string 155 is calculated. According to some embodiments, the resonant frequency is determined using the equation:

$$\text{resonant frequency} = \sqrt{\frac{Kf}{I}},$$

wherein $K_f$=effective torsional spring constant or stiffness of the drill string, and I=moment of inertia of the top drive.

The torsional spring constant changes depending on the length or depth of the drill string 155. In general, as the length of the drill string 155 increases, $K_f$ decreases. In various embodiments, the operator inputs the length of the drill string 155 before slide drilling begins, and the controller 190 calculates the resonant frequency.

At block 504, the controller 190 generates an acceleration profile with the calculated resonant frequency or a substantially similar frequency. In exemplary embodiments, the acceleration profile is a sinusoidal wave-form type (e.g., the sine wave of FIG. 3 or FIG. 5).

At block 506, the controller 190 provides the generated acceleration profile to the top drive 140. In certain embodiments, the top drive 140 is used to generate a torsional wave (e.g., a sine wave) that propagates through the drill string 155 to minimize or even avoid issues with static friction. It should be noted that such waves might be controlled such that they do not fully propagate to the end of the drill string 155. Due to the length of the drill string 155 and other factors, the drill string 155 and friction may absorb some of the motion, and those of ordinary skill in the art understand that this can be accounted for as well through any available technique in carrying out the present disclosure. Thus, the wave may serve to overcome static friction at certain points along the drill string 155 without necessarily changing the orientation of the bit 175. For example, a wave may be propagated through the drill string 155 to a location identified as being a source of static friction without substantially impacting the orientation of the BHA 170 at a location further downhole. Including forward and reverse components of the acceleration profile may encourage this characteristic of operation. Torque from the mud motor may be taken into account and a neutral portion of the drill string 155 may be defined by limiting the reach of torque applied and the propagation of a related wave by the top drive 140.

In certain embodiments, the generated acceleration profile has a small oscillation amplitude (e.g., maximum of ±5 RPM). Ideally, the drill string oscillation amplitude rotates the drill string 155 in one direction as far as possible without rotating the toolface. Then, the drill string 155 is rotated in the opposite direction as far as possible without rotating the toolface. There may be some minor movement of the toolface, but so long as it effectively retains its orientation this can be said to be without rotation of the toolface. This oscillation reduces the friction on the drill string 155. Reduced friction improves drilling performance, because more pressure may be applied to the bit 175 for drilling operations.

In various embodiments, the controller 190 adds the generated small amplitude acceleration profile over a triangular acceleration profile (e.g., FIG. 4) that is typically used to rock the drill string 155 back and forth without losing the desired toolface orientation. For example, the acceleration profile of FIG. 3 may be imposed over the acceleration profile of FIG. 4 to provide a modified acceleration profile, e.g., as shown in FIG. 5, that tunes the drill string to its resonant frequency while also rocking the drill string with symmetric or asymmetric rotation according to FIG. 4. The small amplitude acceleration profile typically does not make the BHA 170 lose its pre-set or desired toolface orientation and will cause the drill string 155 to vibrate or oscillate at its natural or resonant frequency or a substantially similar frequency.

In other embodiments, the generated acceleration profile is used to program the rocking speed of the quill 145 or the top drive 140 with the resonant frequency (or a substantially similar frequency). In these embodiments, the oscillation amplitude is not necessarily limited to a small amplitude. Instead, the generated acceleration profile may be used to fully oscillate the drill string 155 at the resonant frequency. The amount of oscillation, however, should not be so great as to move the BHA 170 to such a degree that desired toolface is changed. Without being bound by theory, it is believed that in certain embodiments, there is sufficient friction between the drill string 155 and wellbore 160 to prevent large oscillations of the drill string 155, even when the drill string 155 is tuned to its resonant frequency.

At block 508, the controller 190 instructs the top drive 140 (or quill 145) to oscillate the drill string 155 based on the generated acceleration profile with the calculated resonant frequency while the drill bit 175 is rotating. For example, the controller 190 instructs the top drive 140 to oscillate the drill string according to the modified acceleration profile (e.g., small amplitude FIG. 3 imposed over FIG. 4) or according to the generated acceleration profile. The controller 190 may set the number of left oscillation revolutions and right oscillation revolutions to tune the drill string 155 to its resonant frequency. The oscillation is useful to reduce the amount of friction between the drill string 155 and the wellbore 160, for example by converting static friction to dynamic friction from the oscillating movement.

Figure 7:
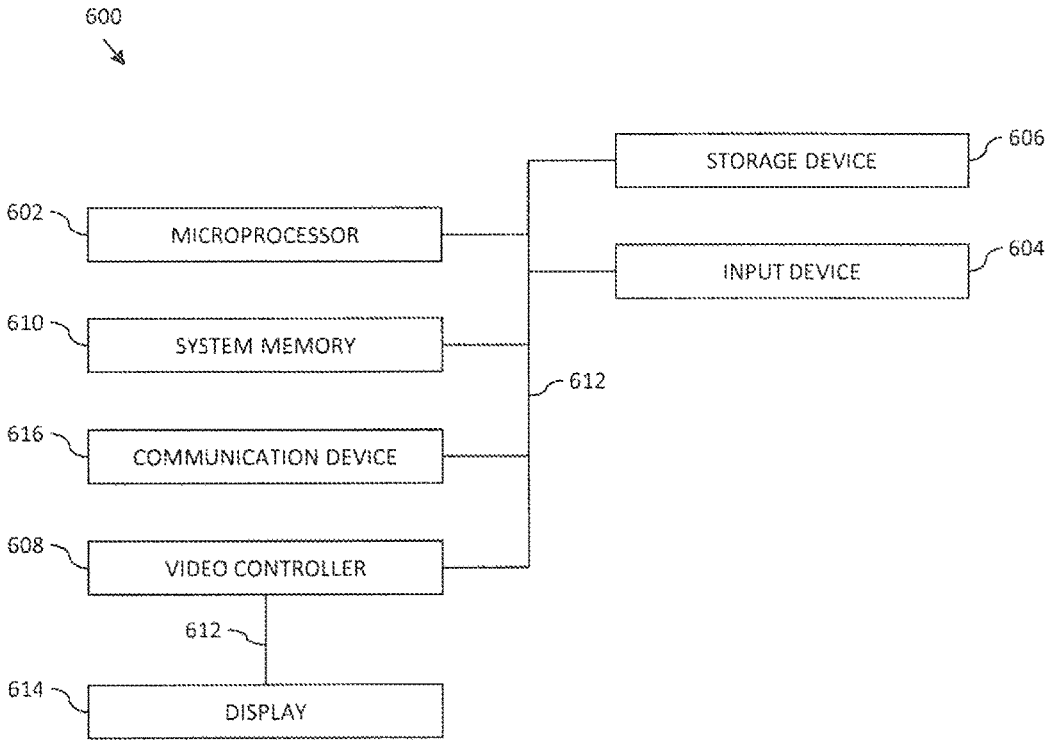
FIG. 7 is a diagram of an exemplary system for implementing one or more embodiments of the described apparatuses, systems, or methods according to one or more aspects of the present disclosure.

Referring now to FIG. 7, illustrated is an exemplary system 600 for implementing one or more embodiments of at least portions of the apparatuses and/or methods described herein. The system 600 includes a processor 602, an input device 604, a storage device 606, a video controller 608, a system memory 610, a display 614, and a communication device 616, all interconnected by one or more buses 612. The storage device 606 may be a floppy drive, hard drive, CD, DVD, optical drive, or any other form of storage device. In addition, the storage device 606 may be capable of receiving a floppy disk, CD, DVD, or any other form of computer-readable medium that may contain computer-executable instructions. Communication device 616 may be a modem, network card, wireless router, or any other device to enable the system 600 to communicate with other systems.

A computer system typically includes at least hardware capable of executing machine readable instructions, as well as software for executing acts (typically machine-readable instructions) that produce a desired result. In addition, a computer system may include hybrids of hardware and software, as well as computer sub-systems.

Hardware generally includes at least processor-capable platforms, such as client-machines (also known as personal computers or servers), and hand-held processing devices (such as smart phones, PDAs, and personal computing devices (PCDs), for example). Furthermore, hardware typically includes any physical device that is capable of storing machine-readable instructions, such as memory or other data storage devices. Other forms of hardware include hardware sub-systems, including transfer devices such as modems, modem cards, ports, and port cards, for example. Hardware may also include, at least within the scope of the present disclosure, multi-modal technology, such as those devices and/or systems configured to allow users to utilize multiple forms of input and output—including voice, keypads, and stylus—interchangeably in the same interaction, application, or interface.

Software may include any machine code stored in any memory medium, such as RAM or ROM, machine code stored on other devices (such as floppy disks, CDs or DVDs, for example), and may include executable code, an operating system, as well as source or object code, for example. In addition, software may encompass any set of instructions capable of being executed in a client machine or server—and, in this form, is often called a program or executable code.

Hybrids (combinations of software and hardware) are becoming more common as devices for providing enhanced functionality and performance to computer systems. A hybrid may be created when what are traditionally software functions are directly manufactured into a silicon chip—this is possible since software may be assembled and compiled into ones and zeros, and, similarly, ones and zeros can be represented directly in silicon. Typically, the hybrid (manufactured hardware) functions are designed to operate seamlessly with software. Accordingly, it should be understood that hybrids and other combinations of hardware and software are also included within the definition of a computer system herein, and are thus envisioned by the present disclosure as possible equivalent structures and equivalent methods.

Computer-readable mediums may include passive data storage such as a random access memory (RAM), as well as semi-permanent data storage such as a compact disk or DVD. In addition, an embodiment of the present disclosure may be embodied in the RAM of a computer and effectively transform a standard computer into a new specific computing machine.

Data structures are defined organizations of data that may enable an embodiment of the present disclosure. For example, a data structure may provide an organization of data or an organization of executable code (executable software). Furthermore, data signals are carried across transmission mediums and store and transport various data structures, and, thus, may be used to transport an embodiment of the invention. It should be noted in the discussion herein that acts with like names may be performed in like manners, unless otherwise stated.

The controllers and/or systems of the present disclosure may be designed to work on any specific architecture. For example, the controllers and/or systems may be executed on one or more computers, Ethernet networks, local area networks, wide area networks, internets, intranets, hand-held and other portable and wireless devices and networks.

In view of all of the above and the figures, one of ordinary skill in the art will readily recognize that the present disclosure relates to systems and methods for slide drilling. In one aspect, the present disclosure is directed to a system that includes a controller and a drive system. The controller is configured to determine a resonant frequency of a drill string, generate a rotational acceleration profile having a frequency at least substantially similar to the determined resonant frequency, and provide one or more operational control signals to oscillate the drill string based on the generated rotational acceleration profile. The drive system is configured to receive the one or more operational control signals from the controller, and oscillate the drill string based on the generated rotational acceleration profile so that the drill string oscillates at a frequency substantially similar to the determined resonant frequency while slide drilling.

In a second aspect, the present disclosure is directed to a method of oscillating a drill string while slide drilling. The method includes calculating, by a controller, a resonant frequency of the drill string using an effective torsional spring constant ($K_t$) of the drill string and moment of inertia (I) of a top drive; generating, by the controller, a rotational acceleration profile with the calculated resonant frequency; and transmitting, by the controller, one or more operational control signals that instruct the top drive to oscillate the drill string based on the generated rotational acceleration profile so that the drill string oscillates at a frequency substantially similar to the calculated resonant frequency while slide drilling.

In a third aspect, the present disclosure is directed to a non-transitory machine-readable medium having stored thereon machine-readable instructions executable to cause a machine to perform operations. The operations include determining a resonant frequency of a drill string; generating a rotational acceleration profile including a sine wave having a frequency at least substantially similar to the determined resonant frequency; instructing a top drive to oscillate the drill string based on the generated rotational acceleration profile so that the drill string oscillates at a frequency substantially similar to the determined resonant frequency while slide drilling; and maintaining a desired toolface orientation while slide drilling.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112(f) for any limitations of any of the claims herein, except for those in which the claim expressly uses the word "means" together with an associated function.

What is claimed is:

1. A system, comprising:

a controller configured to:

determine a resonant frequency of a drill string, generate a rotational acceleration profile having a frequency at least substantially similar to the determined resonant frequency, impose the generated rotational acceleration profile over a first acceleration profile to generate a modified acceleration profile, wherein the first acceleration profile rocks the drill string back and forth so as to maintain a desired toolface orientation; and instruct a drive system to oscillate the drill string according to the modified acceleration profile; and the drive system configured to:

receive instructions from the controller, and oscillate the drill string according to the modified acceleration profile so that the drill string oscillates at a frequency substantially similar to the determined resonant frequency while slide drilling.

2. The system of claim 1, wherein the generated rotational acceleration profile comprises a sine wave.

3. The system of claim 2, wherein the sine wave comprises an oscillation amplitude of less than or equal to about 5 rotations per minute (RPM).

4. The system of claim 2, wherein the first acceleration profile comprises a generally triangular rotational acceleration.

5. The system of claim 1, wherein oscillating the drill string based on the modified acceleration profile comprises oscillating a whole length of the drill string.

6. The system of claim 1, wherein the controller is further configured to maintain the desired toolface orientation while oscillating during slide drilling.

7. The system of claim 1, wherein the controller is further configured to change the toolface orientation to a desired toolface orientation while oscillating during slide drilling.

8. A method of oscillating a drill string while slide drilling, which comprises:

calculating, by a controller, a resonant frequency of the drill string using an effective torsional spring constant ($K_f$) of the drill string and moment of inertia (I) of a top drive;

generating, by the controller, a rotational acceleration profile having the calculated resonant frequency;

imposing, by the controller, the generated rotational acceleration profile over a first acceleration profile to generate a modified acceleration profile, wherein the first acceleration profile rocks the drill string back and forth so as to maintain a desired toolface orientation; and instructing the top drive, by the controller, to oscillate the drill string according to the modified acceleration profile so that the drill string oscillates at about the calculated resonant frequency while slide drilling.

9. The method of claim 8, wherein the generated acceleration profile comprises a sine wave.

10. The method of claim 9, wherein the sine wave comprises an oscillation amplitude of less than or equal to about 5 rotations per minute (RPM).

11. The method of claim 9, wherein the first acceleration profile comprises a triangular rotational acceleration profile.

12. The method of claim 8, wherein instructing the top drive to oscillate the drill string according to the modified acceleration profile comprises instructing the top drive to oscillate a whole length of the drill string.

13. A non-transitory machine-readable medium having stored thereon machine-readable instructions executable to cause a machine to perform operations that, when executed, comprise:

determining a resonant frequency of a drill string;

generating a rotational acceleration profile comprising a sine wave having a frequency at least substantially similar to the determined resonant frequency;

imposing the generated rotational acceleration profile over a first acceleration profile to generate a modified acceleration profile, wherein the first acceleration profile rocks the drill string back and forth so as to maintain a desired toolface orientation;

instructing a top drive to oscillate the drill string according to the modified acceleration profile so that the drill string oscillates at a frequency substantially similar to the calculated resonant frequency while slide drilling; and maintaining the desired toolface orientation while slide drilling.

14. The non-transitory machine-readable medium of claim 13, wherein the sine wave comprises an oscillation amplitude of less than or equal to about 5 rotations per minute (RPM).

15. The non-transitory machine-readable medium of claim 13, wherein the first acceleration profile comprises a triangular rotational acceleration profile.

16. The non-transitory machine-readable medium of claim 13, wherein instructing the top drive to oscillate the drill string comprises instructing the top drive to oscillate a whole length of the drill string.

17. A method of oscillating a drill string while slide drilling, which comprises:

calculating, by a controller, a resonant frequency of the drill string using a torsional stiffness of a drill pipe and a moment of inertia of a bottom hole assembly;

generating, by the controller, a rotational acceleration profile having the calculated resonant frequency;

imposing, by the controller, the generated rotational acceleration profile over a first acceleration profile to generate a modified acceleration profile, wherein the first acceleration profile rocks the drill string back and forth so as to maintain a desired toolface orientation; and instructing a top drive, by the controller, to oscillate the drill string according to the modified acceleration profile so that the drill string oscillates at a frequency substantially similar to the calculated resonant frequency while slide drilling.

18. The method of claim 17, wherein the generated rotational acceleration profile comprises a sine wave having an oscillation amplitude of less than or equal to about 5 rotations per minute (RPM).

19. The method of claim 17, wherein the first acceleration profile comprises a triangular rotational acceleration profile.

20. The method of claim 17, further comprising maintaining the desired toolface orientation while oscillating during slide drilling.

21. The method of claim 17, further comprising changing a toolface orientation to the desired toolface orientation while oscillating during slide drilling.

* * * * *